US007264484B2

(12) United States Patent
Takano

(10) Patent No.: US 7,264,484 B2
(45) Date of Patent: Sep. 4, 2007

(54) CONNECTOR AND PORTABLE TERMINAL

(75) Inventor: Hirohisa Takano, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/443,744

(22) Filed: May 30, 2006

(65) Prior Publication Data

US 2006/0276060 A1 Dec. 7, 2006

(30) Foreign Application Priority Data

Jun. 7, 2005 (JP) ..... 2005-167109
Sep. 21, 2005 (JP) ..... 2005-274159

(51) Int. Cl.
*H01R 12/00* (2006.01)

(52) U.S. Cl. ..... 439/74; 439/660

(58) Field of Classification Search ..... 439/74, 439/81, 83, 78, 346, 660
See application file for complete search history.

(56) References Cited

U.S. PATENT DOCUMENTS 5,545,051 A * 8/1996 Summers et al. ..... 439/350
5,975,916 A * 11/1999 Okura ..... 439/74
6,729,890 B2 * 5/2004 Shin ..... 439/74
6,793,506 B1 * 9/2004 Hirata et al. ..... 439/74
7,037,117 B2 * 5/2006 Goto ..... 439/74

* cited by examiner

*Primary Examiner*—Hien Vu
(74) *Attorney, Agent, or Firm*—McCormick, Paulding & Huber LLP

(57) ABSTRACT

A connector includes a plug connector including a plug body, and at least one plug contact held by the plug body; and a receptacle connector including a receptacle body having a plug-in slot, and at least one receptacle contact held by the receptacle body so as to make contact with the plug contact for electric connection when the plug connector is plugged into the plug-in slot. The plug-in slot is formed between an island portion formed on the center of the receptacle body, and opposing wall portions of the receptacle body formed so as to oppose lateral surfaces of the island portion. Four corners at the top of the island portion are formed as slopes which approach the wall portions and extend downward from the top of the island portion, and are connected to the lateral surfaces which extend vertically.

5 Claims, 13 Drawing Sheets

CONNECTOR AND PORTABLE TERMINAL

CROSS REFERENCE TO RELATED APPLICATION

The present invention is related to and claims priority of the following co-pending applications, namely, Japanese Patent Application Nos. 2005-167109 and 2005-274159 filed on Jun. 7, 2005 and Sep. 21, 2005, respectively.

BACKGROUND OF THE INVENTION

1. Field of the Invention

The invention relates to a connector which is composed of a receptacle connector and a plug connector to be coupled to each other for electric connection, and a portable terminal which includes such a connector.

2. Description of the Related Art

Connectors having a receptacle connector and a plug connector, the plug connector being plugged into a plug-in slot of the receptacle connector for electric connection, are used in portable terminals and other devices. Due to miniaturization of such terminals and devices, demands for reduced height of the connector and smaller on-board areas, i.e., miniaturization of the connectors, have been growing.

However, due to such miniaturization, there are problems with such connectors fitting poorly since it is more difficult to visually check a connector fit and the manual positioning, and due to the reduced height of the connectors, slopes for guiding one of the connectors also are required to be made smaller. In view of such problems, there has been proposed a connector in which such guidance slopes are made as large as possible in order to improve the fitting thereof (Japanese Patent Laid-Open Publication No. 2001-273949).

Due to proliferation and intensified sales competition for portable terminals, demands have been growing for higher volume of production and lower cost. One of the measures being taken is the rapid automation of assembly processes. When automating the connector assembly, it is particularly difficult to automate the process of fitting a plug connector to a receptacle connector (mechanically automated fitting of connectors will be hereinafter referred to as automatic fitting) because of positioning accuracy before fitting. More specifically, in a typical assembly process of a connector, a plug connector which is mounted on an FPC board or the like is temporarily placed on a receptacle connector which is mounted on another board. Subsequently, the plug connector is press-fitted from the underside in an assembling machine. If this assembly is automated, it is difficult to improve the positioning accuracy from the temporary placement to the press fit. For this reason, there has been a high demand for connectors that can be fitted in a correct position even if the plug connector and the receptacle connector (yet to be fitted) are largely deviated from the fitting position thereof.

However, in the above-described electrical connectors, it has been difficult to achieve a reduced height while allowing for large fitting deviations which can occur due to manual fitting under poor visibility or can occur during an automatic fitting process. It has been particularly difficult to deal with fitting deviations if the clearance between the boards to be fitted is no greater than 2 mm. Moreover, the connectors often have a generally rectangular shape (in plan view), and the plug-in slot for the plug connector to be plugged in is formed along the longitudinal or lateral direction of the connector. As a result, rotational deviation can occur easily, which leads to a drop in efficiency of the fitting operation. When the electric connectors are force-fitted automatically without absorbing such fitting deviations, contacts may suffer buckling and other damage, and can cause the connector bodies to break. Even if the fitting deviations were to be absorbed, the connectors are hard to align properly and thus tend to be fitted obliquely, which can increase and vary the fitting force, and moreover, results in difficultly in confirming a correct fitting thereof, normally felt by the connector clicking into place.

SUMMARY OF THE INVENTION

According to an aspect of the present invention, a connector is provided, including a plug connector including a plug body made of an insulating member, and at least one plug contact held by the plug body; and a receptacle connector including a receptacle body made of an insulating member, the receptacle body having a plug-in slot for the plug connector to be plugged into and unplugged from, and at least one receptacle contact held by the receptacle body so as to make contact with the plug contact for electric connection when the plug connector is plugged into the plug-in slot. The plug-in slot is formed between an island portion having a generally cuboid shape formed on the center of the receptacle body, and opposing wall portions of the receptacle body formed so as to oppose lateral surfaces of the island portion. Four corners at the top of the island portion are formed as slopes which approach the wall portions and extend downward from the top of the island portion, and are connected to the lateral surfaces which extend vertically.

It is desirable for the plug body to include at least two pilot portions which protrude toward the receptacle connector along a plugging/unplugging direction of the plug connector, each of the pilot portions having at least two pilot slopes which are formed so as to approach each other, and for the receptacle body to include at least two guide recesses for guiding the pilot portions of the plug body, respectively, when the plug connector is plugged into the receptacle connector, each of the guide recesses having at least two guide slopes which are formed so as to guide the pilot slopes, respectively, when the plug connector is plugged into the receptacle connector.

It is desirable for the guide slopes to include the slopes of the island portion.

It is desirable for the wall portions of the island portion to include wall portion pilot slopes which are formed so as to draw away from the opposing wall portions of the receptacle body and extend toward the top of the island portion.

Ridge lines across which the slopes and the lateral surfaces of the island portion connect to each other can be straight or have an arc shape.

In an embodiment, a connector is provided, including a plug connector including a plug body made of an insulating member, and at least one plug contact held by the plug body; and a receptacle connector including a receptacle body made of an insulating member, the receptacle body having a plug-in slot for the plug connector to be plugged into and unplugged from, and at least one receptacle contact held by the receptacle body so as to make contact with the plug contact for electric connection when the plug connector is plugged into the plug-in slot. The plug body includes at least two pilot portions which protrude toward the receptacle connector along a plugging/unplugging direction of the plug connector, each of the pilot portions having at least two pilot slopes which are formed so as to approach each other and protrude from the plug body. The receptacle body includes at least two guide recesses for guiding the pilot portions of the plug body, respectively, when the plug connector is plugged into the receptacle connector, each of the guide recesses having at least two guide slopes which are formed so as to guide the pilot slopes, respectively, when the plug connector is plugged into the receptacle connector.

It is desirable for the plug-in slot to be formed between an island portion formed on the center of the receptacle body and opposing wall portions of the receptacle body formed so as to oppose lateral surfaces of the island portion, and for the guide slopes to be formed on the lateral surfaces of the island portion and inner wall surfaces of the opposing wall portions.

It is desirable for the guide slopes on the lateral surfaces of the island portion to be formed at four corners at a top of the island portion so as to approach the wall portions and extend downward from the top of the island portion, and to be connected to the lateral surfaces which extend vertically.

It is desirable for a height of the island portion from a bottom of the receptacle body to be smaller than a height of the wall portions from the bottom of the receptacle body.

It is desirable for each of the pilot portions to include a point-asymmetric cross-section as viewed in the plugging/unplugging direction of the plug connector.

Each of the pilot portions can have a noncircular cross-section as viewed in the plugging/unplugging direction of the plug connector.

It is desirable for each of the pilot portions to include a flat top surface.

It is desirable for the top surfaces of the pilot portions to have a minimum width which is greater than an arrangement pitch of the receptacle contacts.

It is desirable for the top surfaces of the pilot portions to have a minimum width which is greater than a width of the plug-in slot of the receptacle body.

It is desirable for at least one pilot portion to be formed on each opposing end of the plug body.

It is desirable for the pilot portions to be formed near a longitudinal center of the opposing ends of the plug body.

It is desirable for the receptacle body to include accommodation portions for accommodating the pilot portions, the accommodation portions being formed so as to communicably connect with corresponding the guide recesses in the plugging direction of the plug connector.

It is desirable for the accommodation portions to be formed as through-holes which extend through a bottom of the receptacle body.

It is desirable for the plug body to include two pilot portions, wherein the receptacle body includes two guide recesses corresponding to the two pilot portions, respectively, and wherein a distance from an innermost position of one of the pilot portions to an outermost position of the other of the pilot portions is equal to a distance from an innermost position of one of the guide recesses to an outermost position of the other of the guide recesses.

A portable terminal can be provided so as to include the above-described connector.

BRIEF DESCRIPTION OF THE DRAWINGS

The present invention will be discussed below in detail with reference to the accompanying drawings, in which.

DETAILED DESCRIPTION OF THE PREFERRED EMBODIMENTS

First Embodiment

Hereinafter, a first embodiment of the present invention will be described in detail with reference to the drawings.

A connector according to the first embodiment includes a receptacle connector 10 (FIGS. 1A through 1C) and a plug connector 50 (FIGS. 2A through 2D) which are coupled to each other for electric connection. For example, one of the receptacle connector 10 and the plug connector 50 is formed on a liquid crystal display (LCD) unit (display unit) or a charge coupled device (CCD) unit (image pickup device). The other of the receptacle connector 10 and the plug connector 50 is formed on a substrate to be electrically connected with the unit for operation control.

The receptacle connector 10 and the plug connector 50 are then coupled to establish electric connection between the unit and the substrate. The plug connector 50 and the receptacle connector 10 according to the first embodiment may also be applied to connection inside a portable terminal (such as cellular phones and personal digital assistants (PDAs) including portable computers), and connection between a portable terminal and an external device. It should be appreciated that the receptacle connector 10 and the plug connector 50 may also be applied to display units other than LCD units, such as CRT (Cathode Ray Tube) display units, plasma display units, and organic electroluminescent device display units. The receptacle connector 10 and the plug connector 50 may also be applied to image pickup devices other than CCD units, such as CMOS (Complementary Metal Oxide Semiconductor) units.

(1) Receptacle Connector 10

Figure 1A:
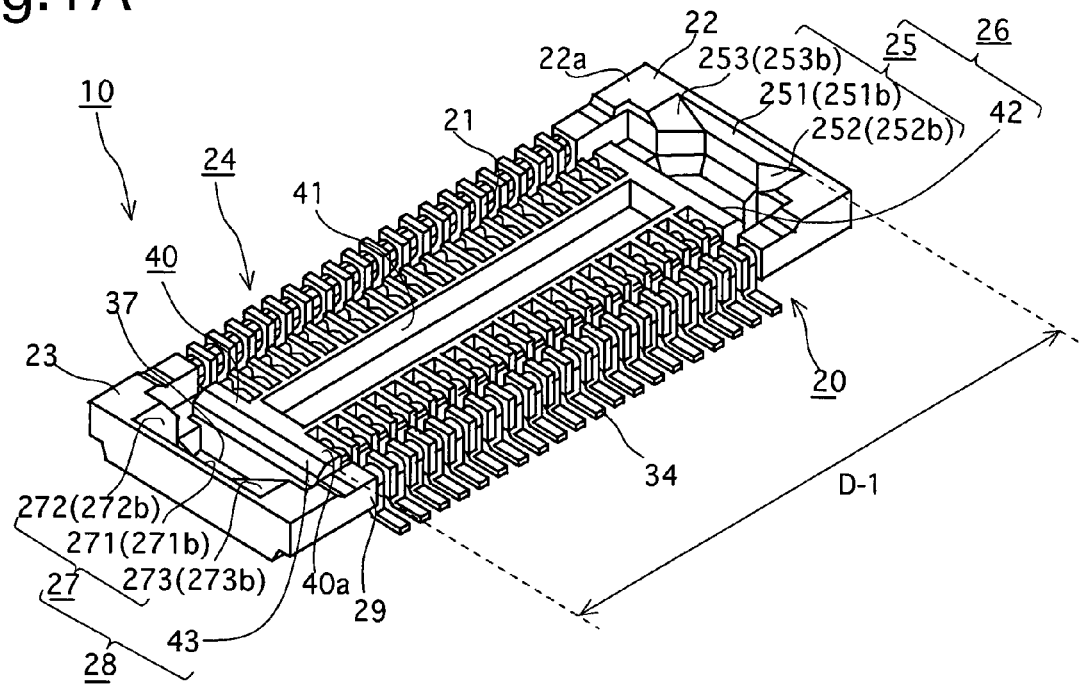
FIG. 1A is a perspective view showing the configuration of a receptacle connector according to a first embodiment of the present invention.
Figure 1B:
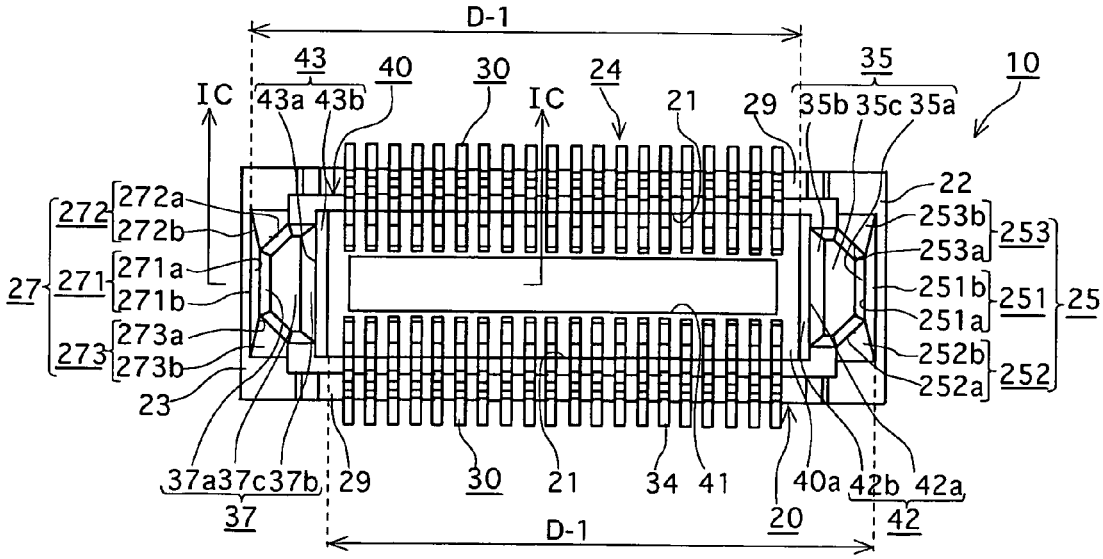
FIG. 1B is a plan view of the receptacle connector of FIG. 1A.
Figure 1C:
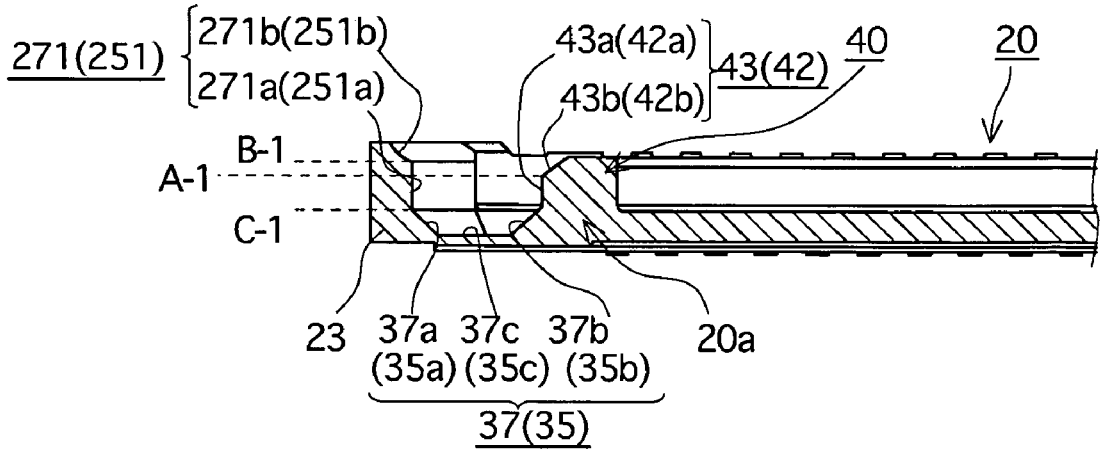
FIG. 1C is a longitudinal sectional view taken along the line IC-IC of FIG. 1B, showing enlarged configuration of a guide recess and an accommodation portion.

The receptacle connector 10 shown in FIGS. 1A through 1C includes a receptacle body 20 and a plurality of receptacle contacts 30. The receptacle contacts 30 are arranged on both sides of a plug-in slot 21 formed in the receptacle body 20. The receptacle body 20 has a generally cuboid shape and includes an island portion 40 having a generally cuboid shape, wall portions 24 having generally rectangular shape, and also includes the plug-in slot 21 for the plug connector 50 to be plugged and unplugged into/from. The island portion 40 is formed on the center of the receptacle body 20. The wall portions 24 are formed along the lateral surfaces of the island portion 40. The plug-in slot 21 is formed in between the island portion 40 and the wall portions 24. The side at which the plug connector 50 is positioned when the plug connector 50 is fitted to the receptacle connector 10 (the top side in FIG. 1A) will be referred to as the top side, and the side at which the receptacle connector 10 is positioned (the bottom side in FIG. 1A) will be referred to as the bottom side.

The receptacle body 20 is an injection molded article of synthetic resin, constituting an insulating member. For example, the insulating member can be made by injection molding Nylon 9T, modified nylon, or liquid crystal polymer. A wall portion 22 of the wall portions 24 that lies on one of the longitudinal ends of the receptacle body 20 includes a guide portion 25 formed near the center of the inner wall of the wall portion 22. The guide portion 25 is formed so as to have a generally trapezoidal section as viewed in the plugging/unplugging direction of the plug connector 50 with respect to the receptacle connector 10 (the vertical direction in FIG. 1A). The lower base of this trapezoidal shape is open an outer wall 42 of the longitudinal end of the island portion 40 on the inner side of the wall portion 22. The inner wall of the wall portion 22 is recessed toward the longitudinal outside of the receptacle body 20, thereby forming guide surfaces 251, 252, and 253. The guide surface 251 corresponds to the upper base of the trapezoidal shape, and the guide surfaces 252 and 253 correspond to the legs of the trapezoidal shape which extend from the respective ends of the guide surface 251. A fitting recess 41 having a generally rectangular shape in plan view is formed in the center of the island portion 40.

A guide portion 27 is formed in the inner wall of a wall portion 23 that lies on the other longitudinal end of the receptacle body 20. The guide portion 27 is formed in a position opposite from the guide portion 25. Likewise with the guide portion 25, the guide portion 27 is also recessed so as to have a generally trapezoidal section as viewed in the plugging/unplugging direction of the plug connector 50. The lower base of this trapezoidal shape is opened toward an outer wall 43 of the longitudinal end of the island portion 40 on the side of the wall portion 23. The inner wall of the wall portion 23 is recessed toward the longitudinal outside of the receptacle body 20, thereby forming guide surfaces 271, 272, and 273. The guide surface 271 corresponds to the upper base of the trapezoidal shape, and the guide surfaces 272 and 273 correspond to the legs of the trapezoidal shape which extend from the respective ends of the guide surface 271.

It is desirable for the guide surfaces 251 and 271 to be made long in the width direction of the receptacle body 20 so that such longer widths can facilitate correction of a rotational deviation (deviation θ) if the plug connector 50 has rotationally deviated with respect to the plane of the receptacle connector 10 when being fitted thereto.

The guide portion 25 and the outer wall 42 constitute a guide recess 26. Likewise, the guide portion 27 and the outer wall 43 constitute a guide recess 28.

As shown in FIGS. 1B and 1C, the guide surfaces 271, 272, and 273 each include erect surfaces 271*a*, 272*a*, and 273*a* and 271*b*, 272*b*, and 273*b*, respectively (FIG. 1B). The erect surfaces 271*a*, 272*a*, and 273*a* are formed along the plugging/unplugging direction of the plug connector 50 (the vertical direction in FIG. 1C). The guide slopes 271*b*, 272*b*, and 273*b* are formed to approach each other as they extend in the plugging direction of the plug connector 50 (the downward direction in FIG. 1C).

The outer wall 43 includes an erect surface 43*a* and a guide slope 43*b*. The erect surface 43*a* is formed along the plugging/unplugging direction of the plug connector 50. The guide slope 43*b* is formed to approach the guide portion 27 as it extends in the plugging direction of the plug connector 50.

As shown in FIG. 1C, the ridge line that defines the border between the erect surface 271*a* and the guide slope 271*b* lies in a position B-1 which is above a position A-1 of the ridge line that defines the border between the erect surface 43*a* and the guide slope 43*b*.

The erect surfaces 271*a*, 272*a*, 273*a*, and 43*a* are connected to an accommodation portion 37 constituting a recess. The accommodation portion 37 includes slopes 37*a* and 37*b*, and a bottom surface 37*c*. The slope 37*a* is connected with the bottoms of the erect surfaces 271*a*, 272*a*, and 273*a*. The slope 37*b* is connected with the bottom of the erect surface 43*a*. The bottom surface 37*c* is connected with the slopes 37*a* and 37*b*. The slopes 37*a* and 37*b* are formed to approach each other as they extend from the erect surfaces 271*a*, 272*a*, and 273*a*, and from the erect surface 43*a*, respectively, in the plugging direction of the plug connector 50.

As shown in FIG. 1C, the ridge line that defines the border between the erect surface 271*a* and the slope 37*a* lies in a position C-1 which is the same as that of the ridge line that defines the border between the erect surface 43*a* and the slope 37*b*.

The guide portions 251, 252, and 253 have the same configurations as those of the guide surfaces 271, 272, and 273. Namely, the guide portions 251, 252, and 253 include erect surfaces 251*a*, 252*a*, and 253*a* and guide slopes 251*b*, 252*b*, and 253*b*, respectively (FIG. 1B). The erect surfaces 251*a*, 252*a*, and 253*a* are formed along the plugging/unplugging direction of the plug connector 50. The guide slopes 251*b*, 252*b*, and 253*b* are formed to approach each other as they extend in the plugging direction of the plug connector 50.

The outer wall 42 includes an erect surface 42*a* and a guide slope 42*b*. The erect surface 42*a* is formed along the plugging/unplugging direction of the plug connector 50. The guide slope 42*b* is formed to approach the guide portion 25 as it extends in the plugging direction of the plug connector 50.

As shown in FIG. 1C, the ridge line that defines the border between the erect surface 251*a* and the guide slope 251*b* lies in the position B-1 which is above the position A-1 of the ridge line that defines the border between the erect surface 42*a* and the guide slope 42*b*.

The erect surfaces 251*a*, 252*a*, 253*a*, and 42*a* are connected to an accommodation portion 35 constituting a recess. The accommodation portion 35 includes slopes 35*a* and 35*b*, and a bottom surface 35*c*. The slope 35*a* is connected with the bottoms of the erect surfaces 251*a*, 252*a*, and 253*a*. The slope 35*b* is connected with the bottom of the erect surface 42*a*. The bottom surface 35*c* is connected with the slopes 35*a* and 35*b*. The slopes 35*a* and 35*b* are formed to approach each other as they extend from the erect surfaces 251*a*, 252*a*, and 253*a*, and from the erect surface 42*a*, respectively, in the plugging direction of the plug connector 50.

As shown in FIG. 1C, the ridge line that defines the border between the erect surface 251*a* and the slope 35*a* lies in the position C-1 which is the same as that of the ridge line that defines the border between the erect surface 42*a* and the slope 35*b*.

Figure 3:
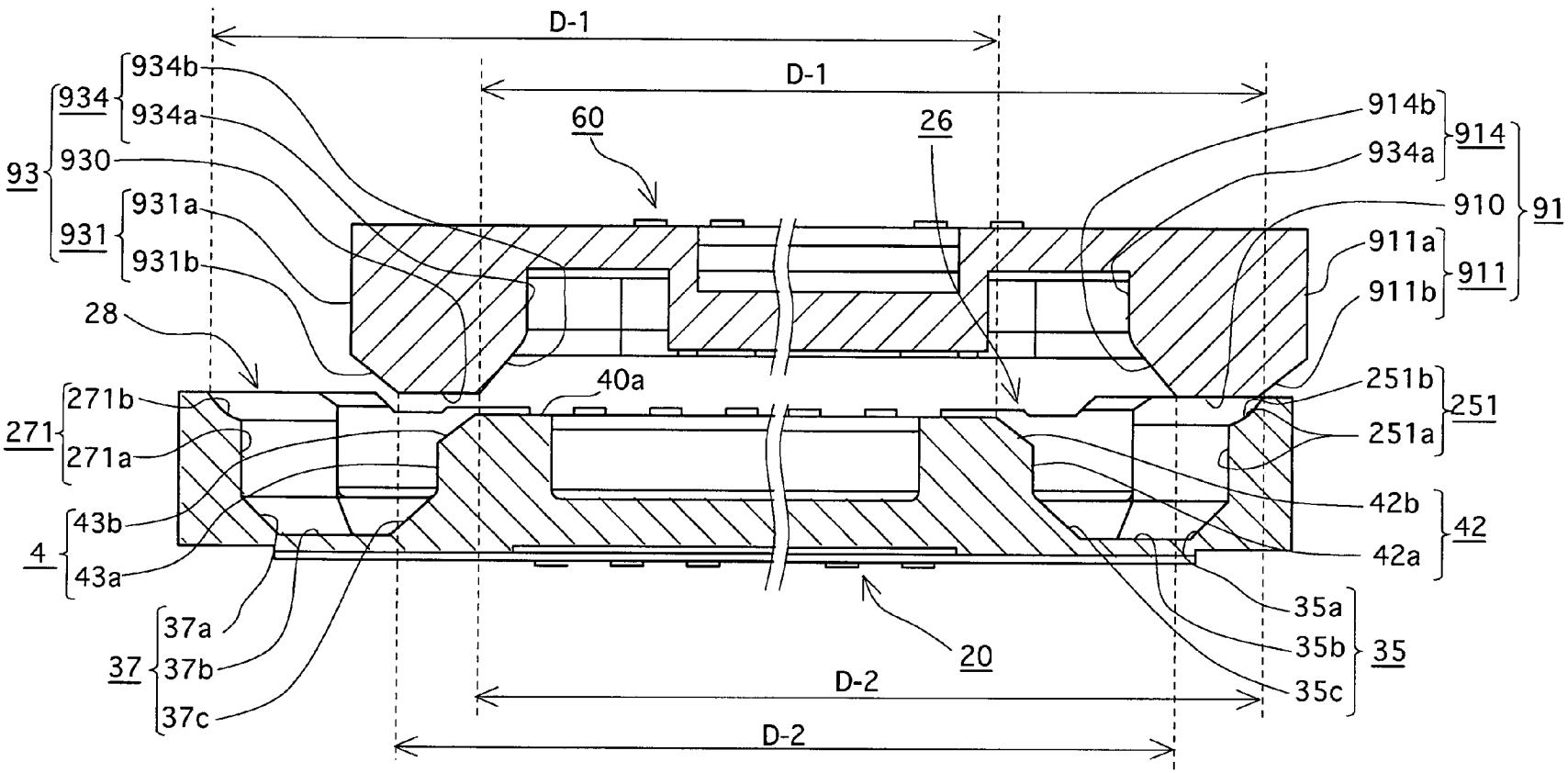
FIG. 3 is a longitudinal sectional view showing a state where the plug connector according to the first embodiment of the present invention is opposed to the receptacle connector, as taken along a longitudinal line that passes through near the lateral centers of the plug connector and the receptacle connector.
Figure 4A:
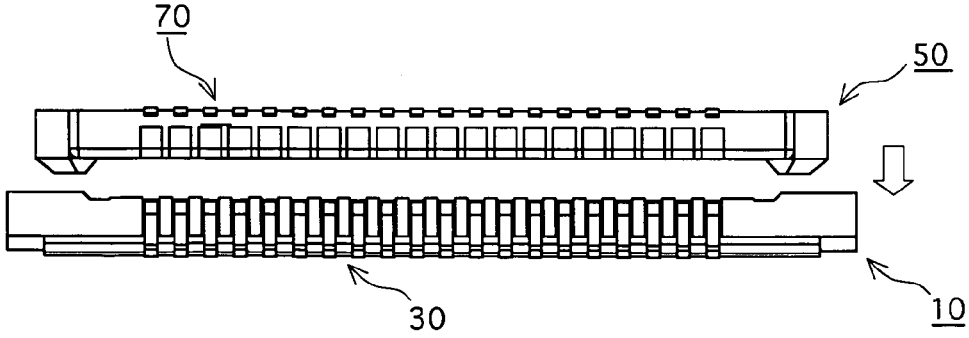
FIG. 4A is a side view showing a state before the plug connector of the first embodiment of the present invention is fitted into the receptacle connector.
Figure 4B:
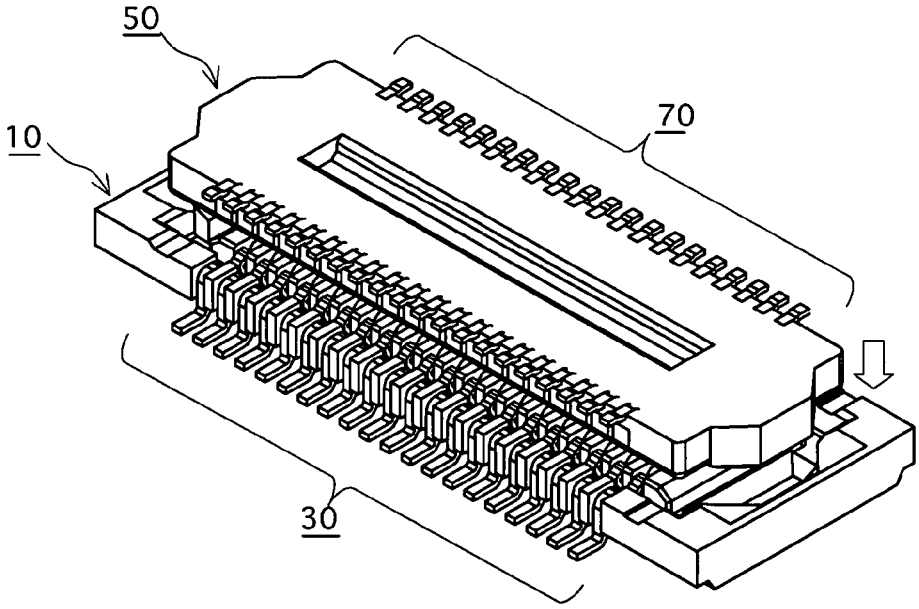
FIG. 4B is a perspective view of the plug connector before being fitted into the receptacle connector shown in FIG. 4A.
Figure 4C:
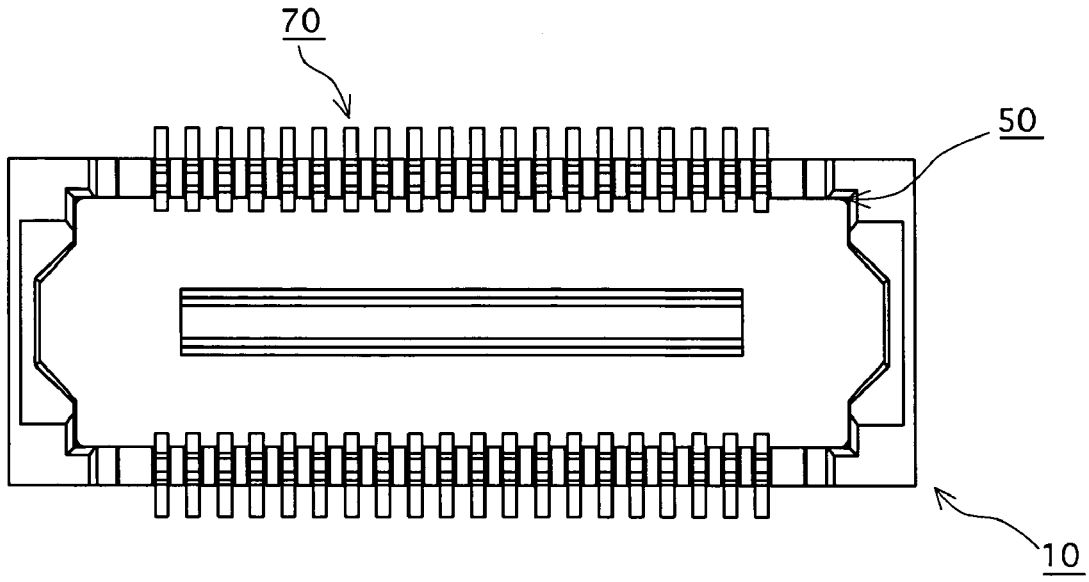
FIG. 4C is a plan view showing a state after the plug connector is fitted into the receptacle connector.

As shown in FIGS. 1A, 1B, and 3, the distance from the border line between a top surface 22*a* of the wall portion 22 and the slope 251*b*, which is the outermost of the slopes 251*b* to 253*b* in the longitudinal direction of the receptacle body 20, to the border line between the slope 43*b* and the top surface 40*a* of the island portion 40 is D-1 when measured in the longitudinal direction of the receptacle body 20. This distance D-1 is the same as the distance from the border line between a top surface 23*a* of the wall portion 23 and the slope 271*b*, which is the outermost of the slopes 271*b* to 273*b* in the longitudinal direction of the receptacle body 20, to the border line between the guide slope 42*b* and the top surface 40*a* of the island portion 40 when measured in the longitudinal direction of the receptacle body 20.

The receptacle contacts 30 are made of metal strips formed by stamping. Specifically, undercoat plating (such as nickel plating) is applied to a base material (such as phosphor bronze), followed by finish plating (such as gold plating), and thereafter the strips are bent into predetermined shapes so as form the receptacle contacts 30. Due to the small-sized connector, and in view of spring design and workability thereof, the receptacle contacts 30 desirably have a thickness of 0.05 mm to 0.15 mm if the connector pitch is, e.g., 0.3 mm to 0.5 mm. The receptacle contacts 30 are arranged on both sides of the plug-in slot 21 and pressed into the receptacle body 20. Receptacle-side terminals 34 extended out from the plug-in slot 21 are soldered to a conductive pattern of the mount target (for example, circuit board) to complete the receptacle connector. It should be appreciated that the receptacle contacts 30 can be accommodated only inside the longitudinal wall portions 29 of the wall portions 24, or inside the island portion 40 as well.

(2) Plug Connector 50

The plug connector 50 shown in FIGS. 2A through 2D includes a plug body 60 of generally cuboid shape, and a plurality of plug contacts 70 each made of a metal strip member. The plug body 60 is an insert molded article of synthetic resin, constituting an insulating member. The plug contacts 70 are arranged on both longitudinal walls of the plug body 60 so as to correspond to the receptacle contacts 30 of the receptacle connector 10 at the same pitch. The plug body 60 has a generally cuboid configuration, and includes a protrusion 61, wall portions 62, and a recess 63. The protrusion 61 is formed on the center of the plug body 60. The wall portions 62 have a generally rectangular shape and are formed along the lateral surfaces of the protrusion 61. The protrusion 61 fits into the fitting recess 41 when the plug connector 50 is fitted to the receptacle connector 10.

The plug body 60 is an insulating member made of, for example, Nylon 9T™, modified nylon, or liquid crystal polymer. The plug body 60 is integrally molded (insert molded) with the plug contacts 70. Among the wall portions 62 of the plug body 60, the wall portion 64 lying on one of the longitudinal ends of the plug body 60 includes a pilot portion 91. The pilot portion 91 is formed at a position so as to correspond to the guide portion 25 of the receptacle connector 10 when the plug connector 50 is fitted to the receptacle connector 10. The wall portion 65 on the other longitudinal end of the plug body 60 has a pilot portion 93. The pilot portion 93 is formed at a position so as to correspond to the guide portion 27 of the receptacle connector 10 when the plug connector 50 is fitted to the receptacle connector 10.

Figure 2A:
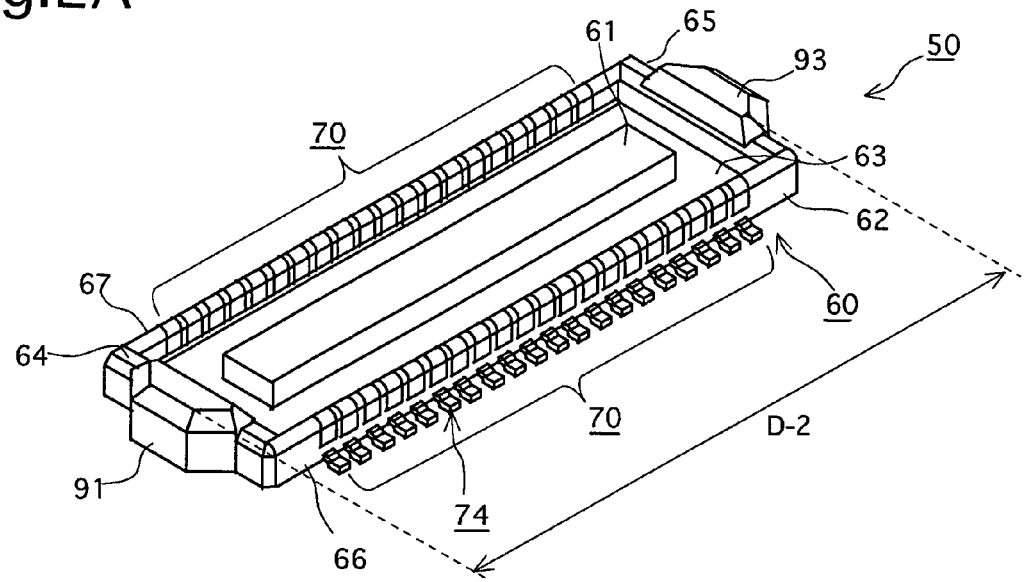
FIG. 2A is a perspective view showing the configuration of a plug connector according to the first embodiment of the present invention.

The pilot portions 91 and 93 have the shape of a column which extends in the plugging/unplugging direction of the plug connector 50 with respect to the receptacle connector 10 (in the vertical direction in FIG. 2A). The top portions of the pilot portions 91 and 93 protrude toward the receptacle connector 10 in the plugging/unplugging direction of the plug connector 50.

The pilot portion 91 includes a top surface 910, and pilot surfaces 911, 912, 913, and 914. The top surface 910 has a generally trapezoidal shape in plan view, and lies at the top of the pilot portion 91. The pilot surfaces 911, 912, 913, and 914 are connected with the upper base, the two legs, and the lower base of the trapezoidal shape of the top surface 910, respectively. Among these surfaces, the pilot surfaces 911, 912, and 913 include erect surfaces 911*a*, 912*a*, and 913*a*, and pilot slopes 911*b*, 912*b*, and 913*b*, respectively. The erect surfaces 911*a*, 912*a*, and 913*a* extend along the plugging/unplugging direction of the plug connector 50. The pilot slopes 911*b*, 912*b*, and 913*b* extend from the respective erect surfaces so as to approach each other as they extend in the plugging direction of the plug connector 50 (the upward direction in FIGS. 2A and 2D). The pilot surface 914 includes an erect surface 914*a* and a pilot slope 914*b*. The erect surface 914*a* extends along the plugging/unplugging direction of the plug connector 50. The pilot slope 914*b* extends from the erect surface 914*a* so that the erect surface 914*a* and the pilot slope 911*b* approach each other as they extend in the plugging direction of the plug connector 50. The top surface 910 has a minimum width greater than the width of the plug-in slot 21, greater than the pitch of the receptacle contacts 30, and greater than the gaps of the receptacle contacts 30 for the plug contacts 70 to be inserted into.

Figure 2B:
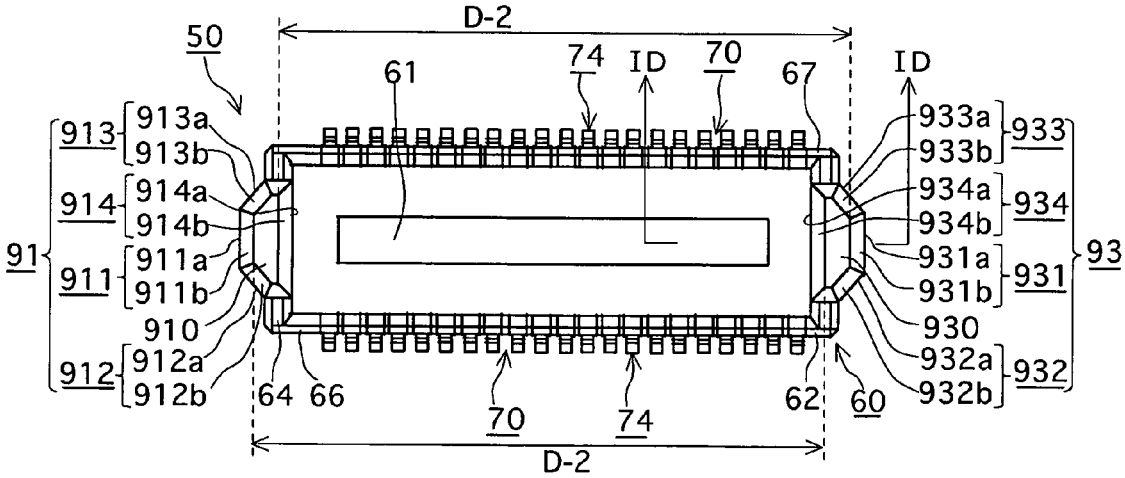
FIG. 2B is a plan view of the plug connector of FIG. 2A.
Figure 2C:
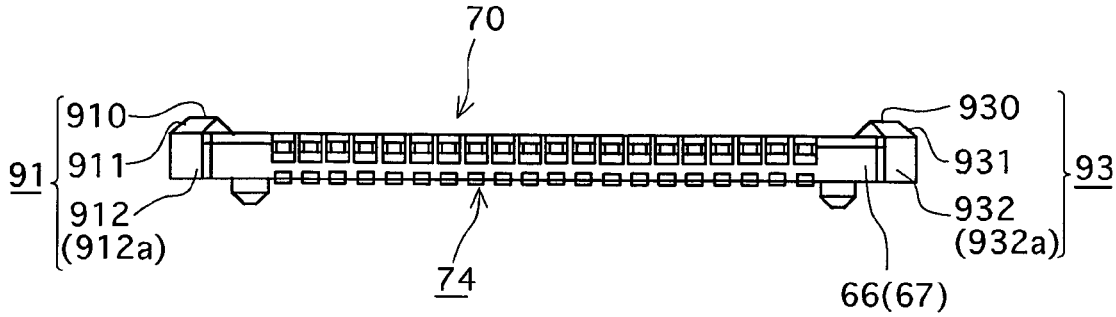
FIG. 2C is a side view of the plug connector of FIG. 2A.
Figure 2D:
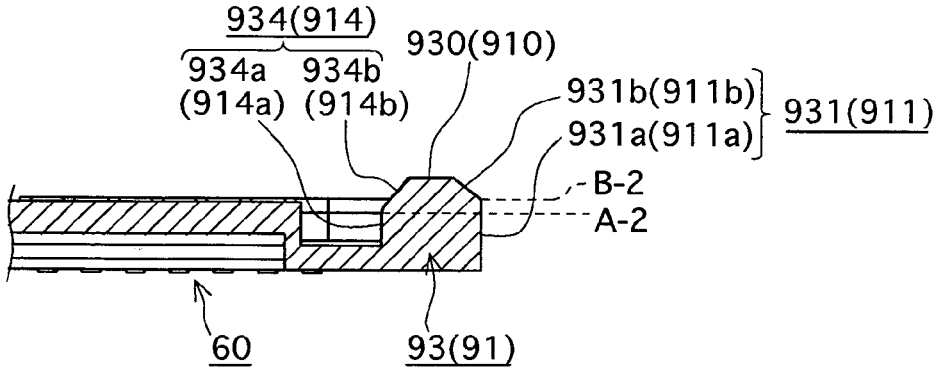
FIG. 2D is a longitudinal sectional view taken along the line IID-IID of FIG. 2B, showing the configuration of a pilot portion.

As shown in FIG. 2D, the ridge line that defines the border between the erect surface 911*a* and the guide slope 911*b* lies in a position B-2 which is above a position A-2 of the ridge line that defines the border between the erect surface 914*a* and the guide slope 914*b*.

The pilot portion 93 has the same configuration as that of the pilot portion 91. More specifically, the pilot portion 93 includes a top surface 930, and pilot surfaces 931, 932, 933, and 934. The top surface 930 has a generally trapezoidal shape in plan view, and lies at the top of the pilot portion 93. The pilot surfaces 931, 932, 933, and 934 are connected to the upper base, the two legs, and the lower base of the trapezoidal shape of the top surface 910, respectively. Among these surfaces, the pilot surfaces 931, 932, and 933 include erect surfaces 931*a*, 932*a*, and 933*a*, and pilot slopes 931*b*, 932*b*, and 933*b*, respectively. The erect surfaces 931*a*, 932*a*, and 933*a* extend along the plugging/unplugging direction of the plug connector 50. The pilot slopes 931*b*, 932*b*, and 933*b* extend from the respective erect surfaces 931*a*, 932*a*, and 933*a* so as to approach each other as they extend in the plugging direction of the plug connector 50. The pilot surface 934 includes an erect surface 934*a* and a pilot slope 934*b*. The erect surface 934*a* extends along the plugging/unplugging direction of the plug connector 50. The pilot slope 934*b* extends from the erect surface 934*a* so that the guide slope 934*b* and the pilot slope 931*b* approach each other as they extend in the plugging direction of the plug connector 50. As shown in FIG. 2D, the ridge line that defines the border between the erect surface 931*a* and the guide slope 931*b* lies in the position B-2 which is above the position A-2 of the ridge line that defines the border between the erect surface 934*a* and the guide slope 934*b*.

Since the position B-1 is higher than the position A-1 and the position B-2 is higher than the position A-2 as described above, the plug connector 50, when fitted, starts to be guided by its peripheral surface (outside). The plug connector is subsequently guided based on the island portion 61 so as to fit in a stable manner.

Moreover, since the distance from the position B-1 to the position B-2 is greater than the distance from the position A-1 to the position A-2, the periphery of the plug body 60 can be held by a large area of the opposing receptacle body 20 even after being fitted. This makes the plug connector 50 harder to detach from the receptacle connector 10 even under external disturbances (such as dropping and impact). In particular, the slopes formed on the pilot portions 91 and 93 and the guide recesses 26 and 28 can suppress detachment of the plug connector 50 from the receptacle connector 10.

As shown in FIGS. 2A, 2B, and 3, the distance from the border line between the top surface 930 and the slope 934*b* of the pilot surface 934, which is the innermost of the pilot surfaces 931 to 934 in the longitudinal direction of the plug body 60, to the border line between the top surface 910 and the pilot slope 911*b* of the pilot surface 911, which is the outermost of the pilot surfaces 911 to 914 in the longitudinal direction of the plug body 60, is D-2 when measured in the longitudinal direction of the plug body 60. This distance D-2 is the same as the distance from the border line between the top surface 910 and the pilot slope 914*b* of the pilot surface 914, which is the innermost of the pilot surfaces 911 to 914 in the longitudinal direction of the plug body 60, to the border line between the top surface 930 and the pilot slope 931*b* of the pilot surface 931, which is the outermost of the pilot surfaces 931 to 934 in the longitudinal direction of the plug body 60, when measured in the longitudinal direction of the plug body 60. This distance D-2 is the same as the distance D-1. According to the above-described constructions of the receptacle body 20 and the plug body 60, the pilot portions 91 and 93 can be guided into the guide recesses 26 and 28, respectively, in a well-balanced manner even under poor visibility or via a mechanical fitting procedure. The plug body 60 can thus be fitted to the receptacle body 20 and be properly aligned.

The plug contacts 70 are made of metal strips formed by stamping. Specifically, undercoat plating (such as nickel plating) is applied to the base material (such as phosphor bronze), followed by finish plating (such as gold plating), and thereafter the plated strips are bent into predetermined shapes so as to form the plug contacts 70. Due to the small-sized connector, and in view of spring design and workability thereof, the plug contacts 70 desirably have a thickness of 0.05 mm to 0.15 mm if the connector pitch is, e.g., 0.3 mm to 0.5 mm. The plug contacts 70 are pressed into the plug body 60 so as to pierce through wall portions 66 and 67 which are opposed to each other and extend in the longitudinal direction of the plug body 60. Plug-side terminals 74 extended out from the longitudinal wall portions 66 and 67 are soldered to a conductive pattern of the mount target (for example, circuit board) to complete the plug connector.

To fit the plug connector 50 to the receptacle connector 10, the plug connector 50 is initially placed on the receptacle body 20 temporarily, wherein the top surface 910 and the pilot surfaces 911 to 914 of the pilot portion 91 enter into the guide recess 26. The top surface 930 and the pilot surfaces 931 to 934 of the pilot portion 93 enter into the guide recess 28.

In the case of an ideal fit where the plug connector 50 and the receptacle connector 10 are already in proper alignment when placed temporarily, the pilot portions 91 and 93 are inserted into the spaces of the guide recesses 26 and 28, respectively, and the plug contacts 70 and the receptacle contacts 30 contact each other. When the plug connector.50 is pressed toward the receptacle connector 10 in this state, the plug contacts 70 are inserted and the receptacle contacts 30 start to open. When the plug connector 50 is pressed further until it reaches a predetermined fitting position, the plug contacts 70 go beyond protrusions (not shown) formed on the receptacle contacts 30. Hence, a correct fitting of the plug contacts 70 and the receptacle contacts 30 can be confirmed by being felt clicking into place. The plug connector 50 is further pressed so that the ends of the plug contacts 70 come into contact with the bottom of the plug-in slot 21. This restrains the movement and completes the fitting procedure. Consequently, the top surface 910 and the pilot surfaces 911 to 914 are inserted in the accommodation portion 35, and the top surface 930 and the pilot surfaces 931 to 934 are inserted in the accommodation portion 37 (see FIGS. 4A to 5B).

Figure 5A:
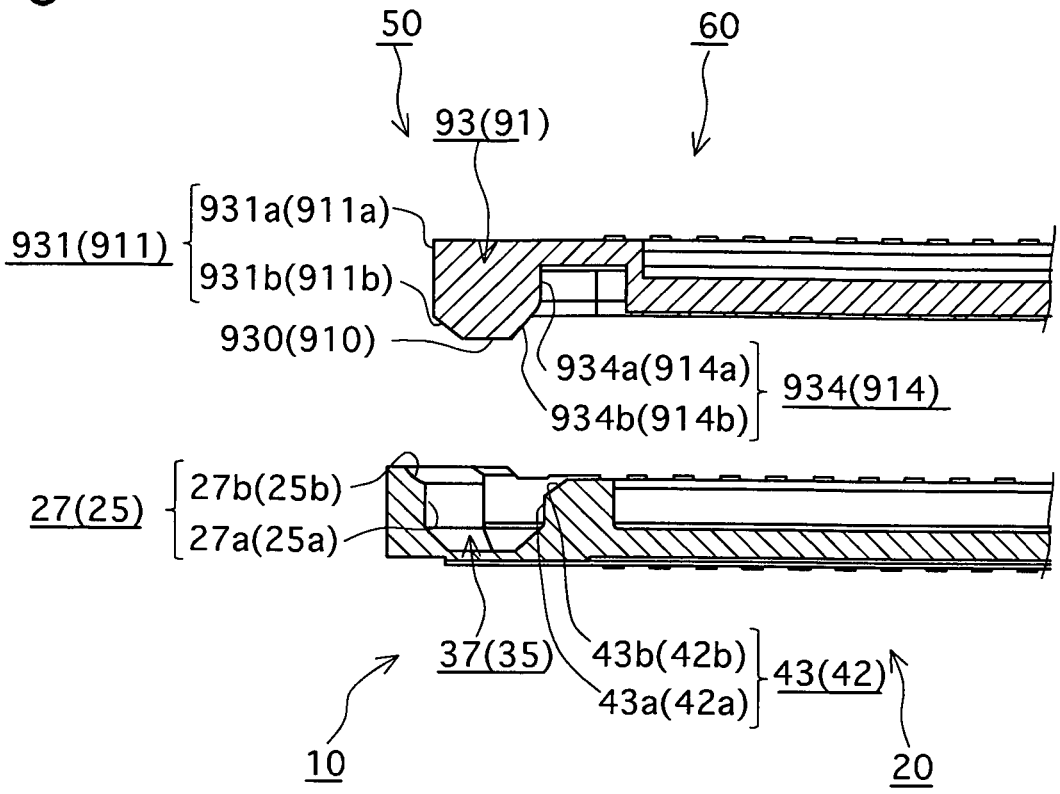
FIG. 5A is a longitudinal sectional view showing how a pilot portion is inserted into a guide portion when the plug connector of the first embodiment of the present invention is fitted into the receptacle connector.
Figure 5B:
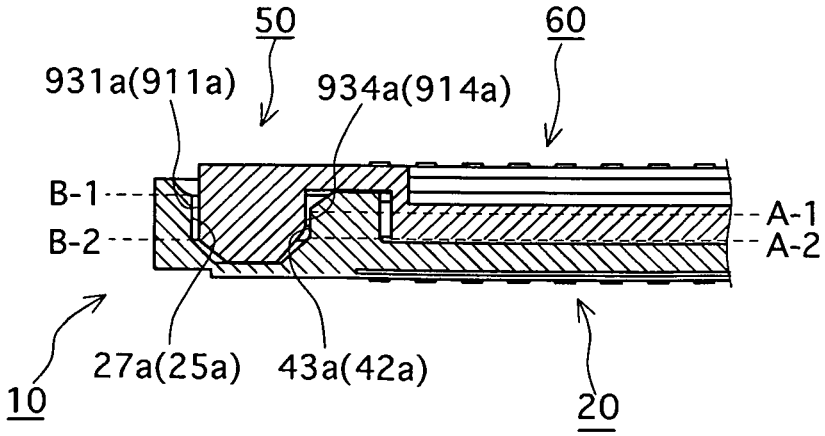
FIG. 5B is a longitudinal sectional view showing the plug connector fitted into the receptacle connector after the state thereof shown in FIG. 5A.

As shown in FIG. 5B, when the fitting of the plug connector 50 to the receptacle connector 10 is completed, the erect surface 42*a* (or 43*a*) and the erect surface 914*a* (or 934*a*) are opposed to each other between the ridge positions A-1 and A-2. The erect surface 251*a* (or 271*a*) and the erect surface 911*a* (or 931*a*) are opposed to each other between the ridge positions B-1 and B-2. This facilitates the correction of a deviation θ in the process of fitting. It should be appreciated that the relationship among the positions A-1, A-2, B-1, and B-2, and the shapes of the guide portions 25 and 27, the outer walls 42 and 43, and the pilot portions 91 and 93 which determine the positions may be set arbitrarily.

However, fitting in poor visibility conditions or in automated automatic fitting, the behavior of the plug connector 50 with respect to the receptacle connector 10 from the temporary placement thereof to the completed fit thereof can vary depending on the physical relationship therebetween. Thus, three cases will be discussed separately below.

(i) Angular Deviation θ

Figure 6A:
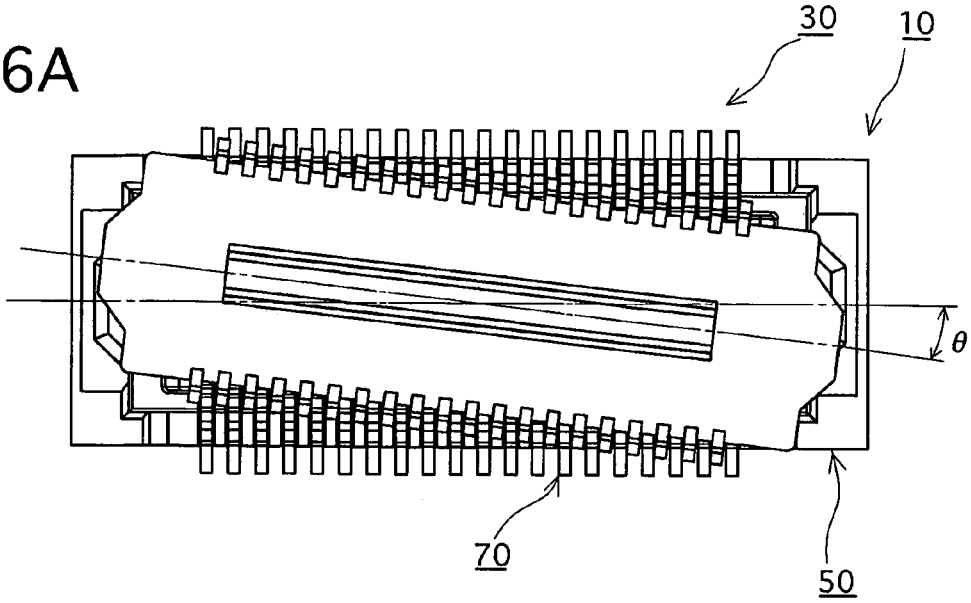
FIG. 6A is a side view showing a state where the plug connector and the receptacle connector of the first embodiment of the present invention are placed at a deviation angle$\theta$.

FIG. 6A shows, in plan view, a case where the receptacle connector 10 and the plug connector 50 are temporarily placed at an angular deviation θ. Even in such a situation, at least one of the slopes 251*b* through 253*b* of the guide recess 26 and the guide slope 42*b* are in contact with two or more of the pilot surfaces 911 through 914 of the pilot portion 91; and at least any one of the slopes 271*b* through 273*b* of the guide recess 28 and the slope 43*b* are in contact with two or more of the pilot surfaces 931 through 934 of the pilot portion 93. Consequently, even if the receptacle connector 10 and the plug connector 50 are temporarily placed at an angular deviation of θ, the pilot portions 91 and 93 are guided by the guide recesses 26 and 28, respectively, while the plug connector 50 is inserted into the receptacle connector 10. Accordingly, such angular deviation θ can be corrected, and a completed fitting procedure can be achieved so that the receptacle connector 10 and the plug connector 50 are properly orientated.

(ii) Parallel Deviation

Figure 6B:
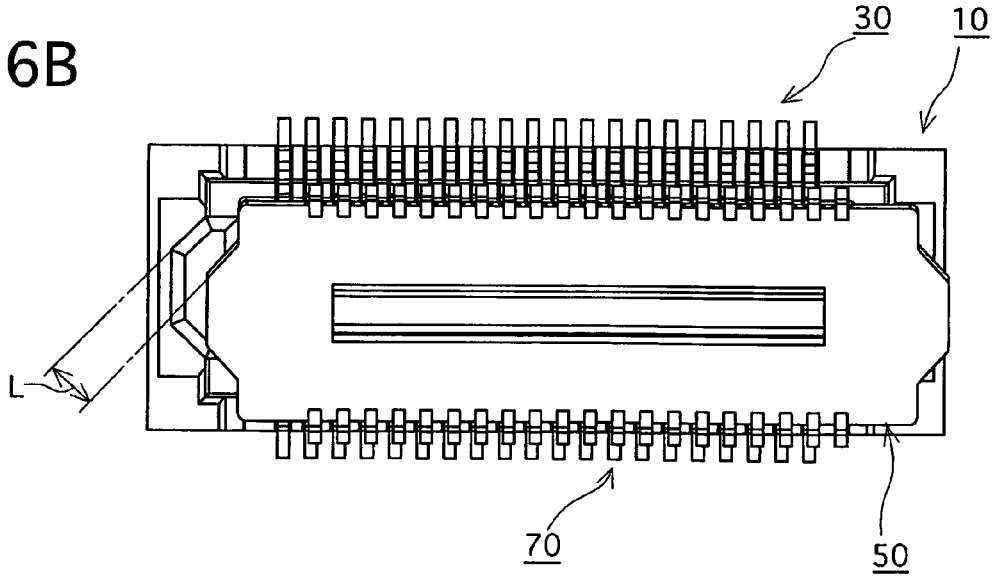
FIG. 6B is a plan view showing a state where the two connectors are placed with a parallel deviation of a distance L.

FIG. 6B shows, in plan view, a case where the receptacle connector 10 and the plug connector 50 are temporarily placed at a parallel deviational distance L. Even in such a situation, at least one of the guide surfaces 251 through 253 of the guide recess 26 or the guide slope 42*b* is in contact with any one of the pilot surfaces 911 through 914 of the pilot portion 91; and one of the guide surfaces 271 through 273 of the guide recess 28 or the slope 43*b* is in contact with one of the pilot surfaces 931 through 934 of the pilot portion 93. Consequently, even if a parallel deviational distance L occurs, the pilot portions 91 and 93 are guided into the guide recesses 26 and 28 by approximately the same amounts, respectively, when the plug connector 50 is inserted into the receptacle connector 10. The fitting of the receptacle connector 10 and the plug connector 50 can thus be completed so as to be properly orientated.

(iii) Complex Deviation

The above described angular deviation θ and parallel deviation L can sometimes occur in combination. In such a situation, at least two pairs out of the slopes 251*b* through 253*b* of the guide recess 26 and the guide slope 42*b*, and the pilot surfaces 911 through 914 of the pilot portion 91, come into contact; and at least two pairs out of the slopes 271*b* through 273*b* of the guide recess 28 and the slope 43*b*, and the pilot surfaces 931 through 934 of the pilot portion 93, come into contact. It is therefore possible to obtain both above-described effects for properly orientating the receptacle connector 10 and the plug connector 50 with respect to the angular deviation θ and the parallel deviation L.

Since the pilot portions 91 and 93 both have a plurality of pilot slopes, and the guide recesses 26 and 28 both have a plurality of guide slopes corresponding to the pilot slopes, it possible, even in the case of fitting deviations, to align the plug connector 50 and the receptacle connector 10 with each other properly before the plug contacts 70 and the receptacle contacts 30 come into contact with each other. Since none of the pilot portions can be inserted into a guide recess by itself alone, the plug connectors are unlikely to be damaged by an uninserted pilot portion.

The top surface 910 and the pilot surfaces 911 through 914 are accommodated into the accommodation portion 35, and the top surface 93 and the pilot surfaces 931 through 934 are accommodated into the accommodation portion 37. The pilot portions 91 and 93 can thus be made greater in height in the plugging/unplugging direction of the plug connector 50. Consequently, a small-sized connector can be achieved with sufficient freedom for correcting fitting deviations.

Since the plug connector 50 constructed so as to fit into the receptacle connector 10, the guide portions are formed in the inner walls of the plug-in slot 21 of the receptacle connector 10. The above-described effects can thus be obtained without enlarging the external shape of the receptacle connector 10 which determines the mounting area. Moreover, the external shape of the receptacle connector 10 can be maintained generally cuboid with few pits and projections.

Hereinafter, description will be given of some modifications.

The number of guide recesses to be formed is not particularly limited as long as the wall portions 22 and 23 each have at least one guide recess. The number of pilot portions to be formed is not particularly limited, as long as the wall portions 64 and 65 each have at least one guide portion. Such configurations can also guide the pilot portions in even if there are fitting deviations.

Furthermore, guide recesses in the receptacle connector 10 can be formed so that fitting can be allowed or rejected depending on the direction of the plug connector 50 with respect to the receptacle connector 10. More specifically, the presence or absence, the positions, and the configurations of the guide portions may be determined so that the plug connector 50 can be fitted into the receptacle connector 10 in one direction while the plug connector 50 cannot be fitted to the receptacle connector 10 if it is rotated 180 degrees on a plane orthogonal to the fitting direction (plugging/unplugging direction).

The guide portions 25 and 27 and the pilot portions 91 and 93 may have sections of any shape as long as they correspond to each other. For example, as an alternative to the above-described generally trapezoidal shapes, the sections may have rectangular, triangular, and other polygonal shapes, semicircular shapes, point-asymmetric shapes, or noncircular shapes.

The accommodation portions 35 and 37 may be formed as through-holes which extend through the bottom 20*a* of the receptacle body 20. According to this configuration, it becomes possible to achieve a lower height and deal with greater fitting deviations since longer pilot portions can be accommodated.

Moreover, alignment bosses may be formed so as to protrude downward from the bottom 20*a* of the receptacle connector 10, and the accommodation portions may be formed even with the bosses. According to this construction, it is possible to increase the heights of the pilot portions 91 and 93 further in the plugging/unplugging direction of the plug connector 50. Since the pilot slopes 911*b* through 914*b* and 931*b* through 934*b* of the pilot portions 91 and 93, respectively, can be made greater, a connector having a lower height can be achieved with even greater freedom for correcting fitting deviations.

Furthermore, holes corresponding to the alignment bosses of the receptacle connector 10 and holes for avoiding interference between the mounting board and the pilot portions 91 and 93 need not be formed separately. Namely, it is possible to share the holes of the mounting board. This increases the design flexibility of the board wiring, and allows higher integration.

When the accommodation portions 35 and 37 are formed in the bosses as closed-bottomed holes, the bottom 20*a* of the receptacle connector 10 has no through-hole to communicate with the exterior. It is therefore possible to avoid flux and gas intrusion when reflowing for securing strength and mounting the receptacle body 20. Moreover, the total height of the plug connector, including the pilot portions 91 and 93, can be made substantially greater than the height between the fitted boards.

According to the first embodiment, the guide recesses 26 and 28 are formed in both longitudinal sides of the receptacle connector 10, respectively, and the corresponding pilot portions 91 and 93 are formed on both longitudinal sides of the plug connector 50, respectively. This can prevent the receptacle body 20 from dropping in strength and the connector assembly system from dropping in productivity due to such reasons as a decrease of the distance between the pilot portions 91 and 93 if the pilot portions 91 and 93 are made larger, and the formation of a plurality of corresponding guide recesses 26 and 28.

It should be appreciated that the numbers, positions, and shapes of the pilot portions 91 and 93 and the guide recesses 26 and 28 may be selected arbitrarily within limitations in design, including the tolerances for fitting deviations required of the connectors, the height between the fitted boards, the presence or absence of fixings, the presence or absence of bosses, and productivity.

The tolerances for fitting deviations may be set arbitrarily depending on the shapes of the top surfaces 910 and 930 and the pilot surfaces 911 through 914 and 931 through 934 of the pilot portions 91 and 93.

Second Embodiment

Figure 7A:
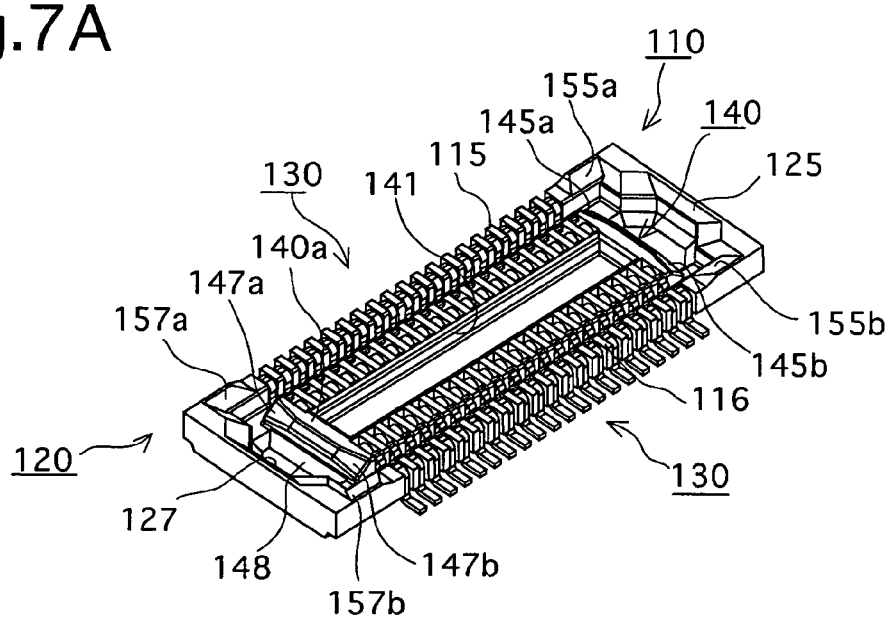
FIG. 7A is a perspective view showing the configuration of the receptacle connector according to a second embodiment of the present invention.
Figure 7B:
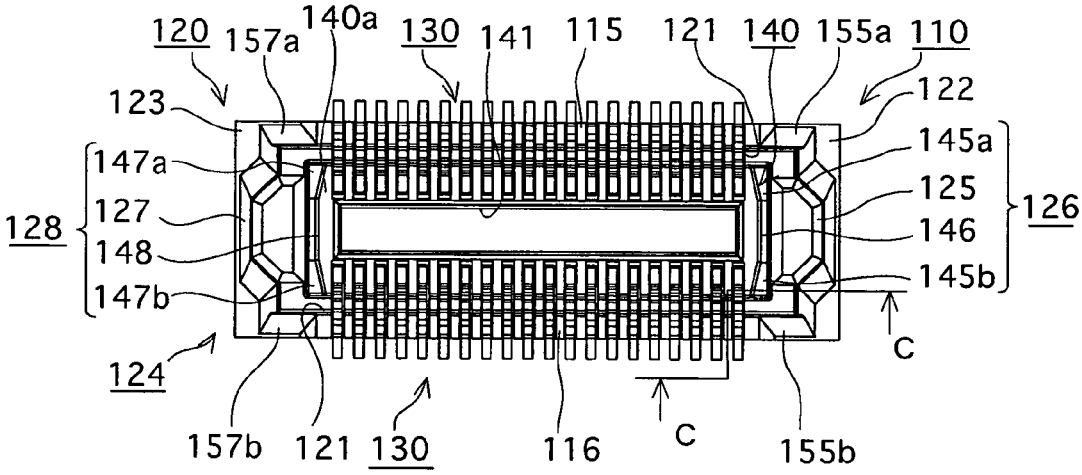
FIG. 7B is a plan view of the configuration shown in FIG. 7A.
Figure 7C:
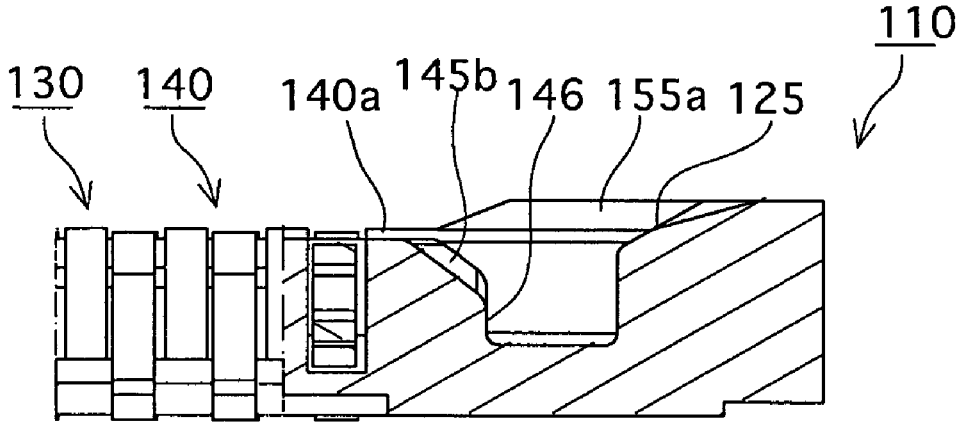
FIG. 7C is an enlarged longitudinal sectional view taken along the line VIIC-VIIC of FIG. 7B.
Figure 8A:
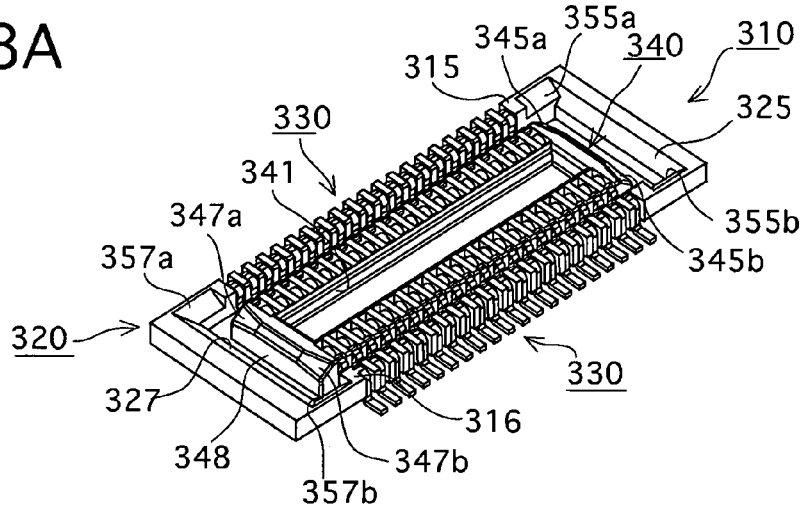
FIG. 8A is a perspective view showing the configuration of the receptacle connector according to a third embodiment of the present invention.
Figure 8B:
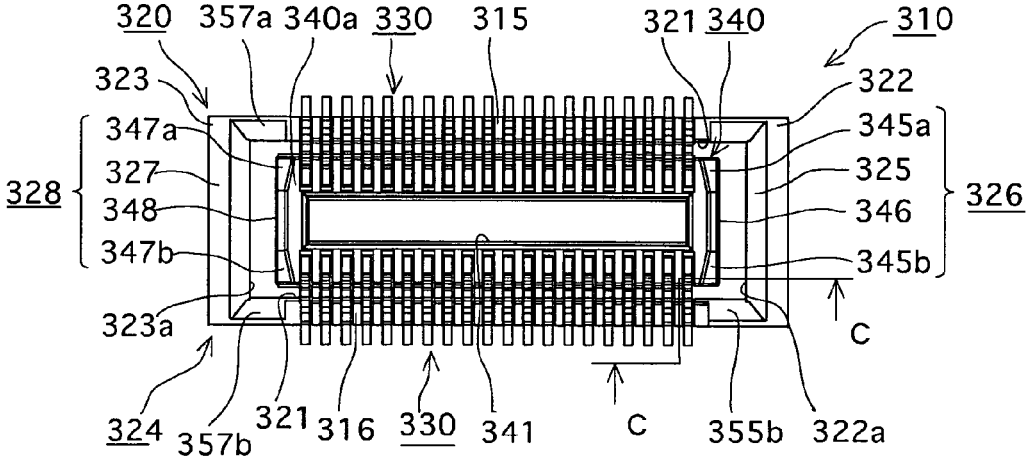
FIG. 8B is a plan view of the configuration shown in FIG. 8B.
Figure 8C:
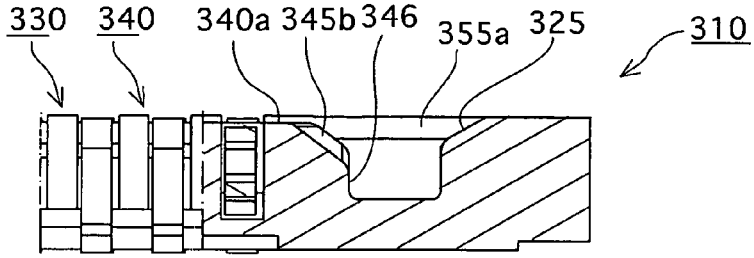
FIG. 8C is an enlarged longitudinal sectional view taken along the line VIIIC-VIIIC of FIG. 8B.

A second embodiment of the present invention will be described with reference to FIGS. 7A through 7C. The second embodiment differs from the first embodiment in that slopes 145*a*, 145*b*, 147*a*, and 147*b* are formed on an island portion 140. Another difference is that wall portion pilot slopes 155*a*, 155*b*, 157*a*, and 157*b* are formed on wall portions 115 and 116 which extend in the longitudinal direction of a receptacle body 120. The plug connector is the same as that (i.e., plug connector 50) of the first embodiment. The remaining construction thereof is the same as that of the first embodiment. Hence, the same members will be designated with the same reference numerals, and redundant description will be omitted.

Likewise with the receptacle connector 10, a receptacle connector 110 according to the second embodiment includes a receptacle body 120 and a plurality of receptacle contacts 130. The receptacle contacts 130 are arranged on both sides of a plug-in slot 121 formed in the receptacle body 120. The receptacle body 120 has a generally cuboid configuration, and includes an island portion 140 of generally cuboid shape, wall portions 124 of generally rectangular shape, and the plug-in slot 121 for the plug connector 50 to be plugged and unplugged into/from. The island portion 140 is formed on the center of the receptacle body 120. The wall portions 124 are formed along the lateral surfaces of the island portion 140. The plug-in slot 121 is formed in between the island portion 140 and the wall portions 124.

Among the wall portions 124 of the receptacle body 120, a wall portion 122 that lies on one of the longitudinal ends of the receptacle body 120 has a guide portion 125 which is formed in the center of its inner wall. The guide portion 125 is formed so that it has a generally trapezoidal section as viewed right across the plugging/unplugging direction of the plug connector 50 with respect to the receptacle connector 110 (the vertical direction in FIG. 1A). A guide portion 127 is formed in the inner wall of a wall portion 123 that lies on the other longitudinal end of the receptacle body 120. The guide portion 127 is formed in a position opposite from the guide portion 125. Likewise with the guide portion 125, the guide portion 127 is also formed so that it has a generally trapezoidal section as viewed across the plugging/unplugging direction of the plug connector 50.

The island portion 140 includes the slopes 145*a*, 145*b*, 147*a*, and 147*b* instead of the guide slopes 42*b* and 43*b* of the first embodiment. The slopes 145*a*, 145*b*, 147*a*, and 147*b* are formed by cutting off the respective four corners of the top surface 140*a* of the island portion 140 so as to approach the opposed portions of the wall portions 124 as they extend downward from the top surface 140*a* (toward the bottom of the receptacle connector 110). The slopes 145*a* and 145*b*, opposed to the guide portion 125, are connected to a lateral surface 146 which extends in the vertical direction (the plugging/unplugging direction) of the island portion 140. The slopes 147*a* and 147*b*, opposed to the guide portion 127, are connected to a lateral surface 148 which extends in the vertical direction of the island portion 140. The ridge lines across which the slopes 145*a* and 145*b* are connected with the lateral surface 145 and the ridge lines across which the slopes 147*a* and 147*b* are connected with the lateral surface 148 are all straight. A fitting recess 141 having a generally rectangular shape in plan view is formed in the center of the island portion 140. The fitting protrusion 61 fits into the fitting recess 141 when the plug connector 50 is fitted to the receptacle connector 110.

The guide portion 125, the slopes 145*a* and 145*b*, and the lateral surface 146 constitute a guide recess 126. The guide portion 127, the slopes 147*a* and 147*b*, and the lateral surface 147 constitute a guide recess 128.

Among the wall portions 124, the wall portion 115 which extends along the longitudinal direction of the receptacle body 120 (the horizontal direction in FIG. 7B) includes the wall portion pilot slopes 155*a* and 157*a* on both ends, respectively. The wall portion pilot slopes 155*a* and 157*a* are connected with the inner wall of the wall portion 115 which extends in the plugging/unplugging direction. The wall portion pilot slopes 155*a* and 157*a* are also formed so as to draw away from the opposite wall portion 116 as they extend toward the top of the wall portion 115. Among the wall portions 124, the wall portion 116 which extends in parallel with the wall portion 115 includes the wall portion pilot slopes 155*b* and 157*b* on both sides, respectively. The wall portion pilot slopes 155*b* and 157*b* are connected with the inner wall of the wall portion 116 which extends in the plugging/unplugging direction. The wall portion pilot slopes 155*b* and 157*b* are also formed so as to draw away from the opposite wall portion 115 as they extend toward the top of the wall portion 116.

As described above, the four corners of the island portion 140 formed on the receptacle body 120 include the slopes 145*a*, 145*b*, 147*a*, and 147*b*, so that in addition to the effects of the first embodiment, this provides the effect of the inner surfaces of the wall portions 64 and 65 and the pilot slopes 914*b* and 934*b* of the plug connector 50 contacting the slopes 145*a*, 145*b*, 147*a*, and 147*b*, whereby the plug connector 50 is guided for easier correction of rotational deviations. This makes it easier to bring the plug connector 50 and the receptacle connector 110 into proper alignment, and hence, it is possible to improve the efficiency of the fitting operation.

The formation of the wall portion pilot slopes 155*a*, 157*a*, 155*b*, and 157*b* facilitates the correction of position deviations since the top surfaces of the wall portions 62 and the pilot portions 91 and 93 of the plug connector 50 make contact with the wall portion pilot slopes 155*a*, 157*a*, 155*b*, and 157*b*.

Namely, position deviations can be corrected both from inside and from outside the plug connector 50. It is therefore possible to obtain a particularly excellent effect for correcting position deviations.

By maintaining the lateral surfaces 146 and 148 after the formation of the slopes 145*a*, 145*b*, 147*a*, and 147*b*, the erect surfaces 914*a* and 934*a* of the plug connector 50 can make contact with the lateral surfaces 146 and 148 when the plug connector 50 is fitted to the receptacle connector 110. It is therefore possible to position the plug connector 50 properly in the longitudinal direction of the receptacle connector 110.

While the above description concerns the case where the ridge lines across which the slopes 145*a* and 145*b* are connected with the lateral surface 146 and the ridge lines across which the slopes 147*a* and 147*b* are connected with the lateral surface 148 are all straight in shape, each ridge line may have an arc shape.

The other operations, effects, and modifications of the second embodiment are the same as in the first embodiment.

Third Embodiment

A third embodiment of the present invention will be described with reference to FIGS. 8A through 9C. In the following description, the same members as those of the first embodiment are designated with the same reference numerals. Redundant description thereof will be omitted.

Likewise with the above-described receptacle connectors 10 and 110, a receptacle connector 310 according to the third embodiment includes a receptacle body 320 and a plurality of receptacle contacts 330. The receptacle contacts 330 are arranged on both sides of a plug-in slot 321 formed in the receptacle body 320. The receptacle body 320 has a generally cuboid shape, and includes an island portion 340 having a generally cuboid shape, wall portions 324 having a generally rectangular shape, and the plug-in slot 321 for a plug connector 350 to be plugged and unplugged into/from. The island portion 340 is formed on the center of the receptacle body 320. The wall portions 324 are formed along the lateral surfaces of the island portion 340. The plug-in slot 321 is formed in between the island portion 340 and the wall portions 324.

Among the wall portions 324 of the receptacle body 320, the wall portions 322 and 323 that are opposed to each other on both longitudinal ends of the receptacle body 320 have guide surfaces 325 and 327, respectively. The guide surfaces 325 and 327 are formed on the inner walls of the wall portions 322 and 323 so as to approach the opposite wall portions as they extend downward from the tops, and are connected to inside surfaces 322*a* and 323*a* which extend vertically.

The island portion 340 has slopes 345*a*, 345*b*, 347*a*, and 347*b*. The slopes 345*a*, 345*b*, 347*a*, and 347*b* are formed by cutting off the respective four corners of the top surface 340*a* so as to approach the opposed portions of the wall portions 324 as they extend downward from the top surface 340*a* (toward the bottom of the receptacle connector 310). The slopes 345*a* and 345*b*, opposed to the guide surface 325, are connected to a lateral surface 346 which extends in the vertical direction of the island portion 340. The slopes 347*a* and 347*b*, opposed to the guide surface 327, are connected to a lateral surface 348 which extends in the vertical direction of the island portion 340. The ridge lines across which the slopes 345*a* and 345*b* are connected with the lateral surface 345 and the ridge lines across which the slopes 347*a* and 347*b* are connected with the lateral surface 347 are all straight in shape. A fitting recess 341 having a generally rectangular shape in plan view is formed in the center of the island portion 340.

The guide surface 325, the slopes 345*a* and 345*b*, and the lateral surface 346 constitute a guide recess 326. The guide surface 327, the slopes 347*a* and 347*b*, and the lateral surface 348 constitute a guide recess 328.

Among the wall portions 324, a wall portion 315 which extends along the longitudinal direction of the receptacle body 320 (the horizontal direction in FIG. 8B) has wall portion pilot slopes 355*a* and 357*a* on both ends, respectively. The wall portion pilot slopes 355*a* and 357*a* are connected to the inner wall of the wall portion 315 which extends in the plugging/unplugging direction. The wall portion pilot slopes 355*a* and 357*a* are also formed so as to draw away from the opposite wall portion 316 as they extend toward the top of the wall portion 315. Among the wall portions 324, the wall portion 316 that extends in parallel with the wall portion 315 has wall portion pilot slopes 355*b* and 357*b* on both ends, respectively. The wall portion pilot slopes 355*b* and 357*b* are connected to the inner wall of the wall portion 316 which extends in the plugging/unplugging direction. The wall portion pilot slopes 355*b* and 357*b* are also formed so as to draw away from the opposite wall portion 315 as they extend toward the top of the wall portion 316.

Figure 9A:
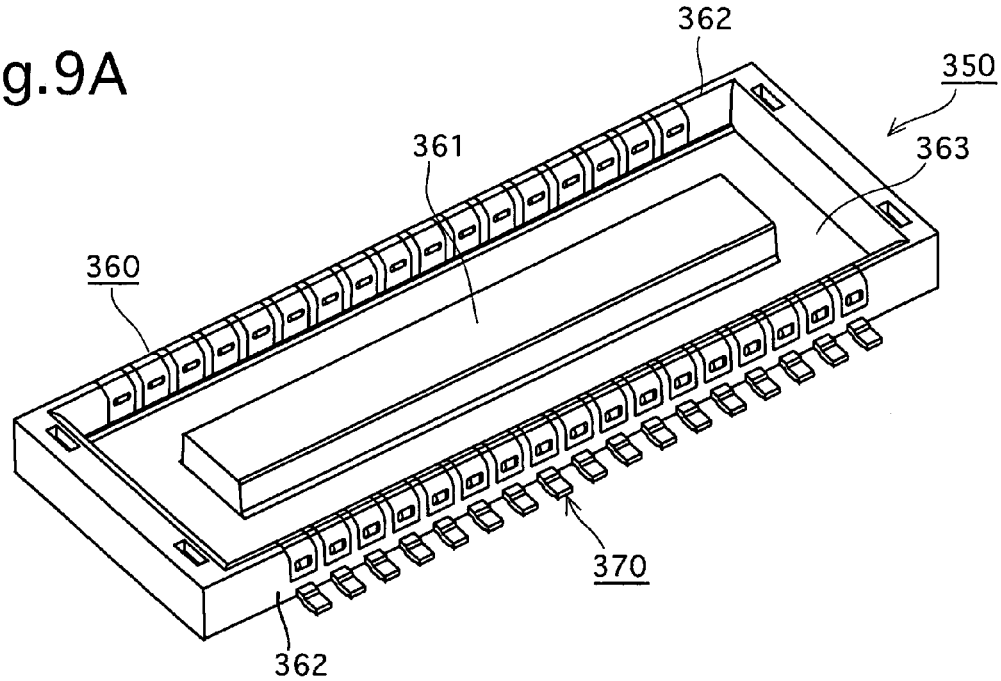
FIG. 9A is a perspective view showing the configuration of the plug connector according to the third embodiment of the present invention.
Figure 9B:
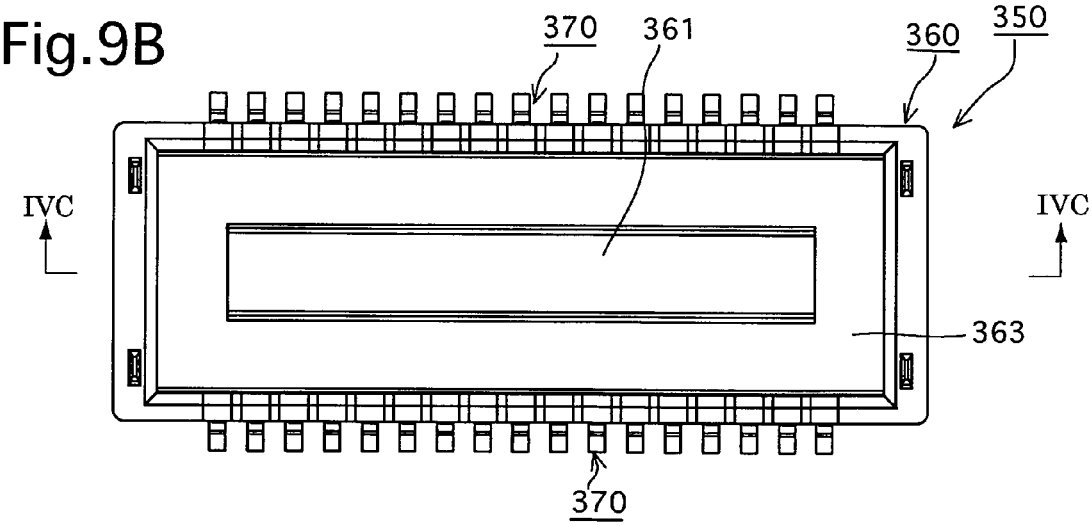
FIG. 9B is a plan view of the configuration shown in FIG. 9A.
Figure 9C:
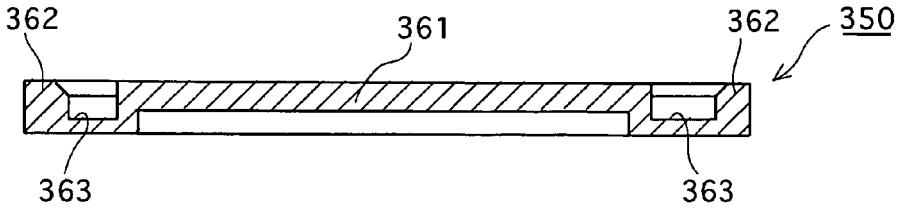
FIG. 9C is an enlarged longitudinal sectional view taken along the line IXC-IXC of FIG. 9B.

The plug connector 350 shown in FIGS. 9A through 9C includes a plug body 360 having a generally cuboid shape, and a plurality of plug contacts 370. The plug body 360 is an insert molded article of synthetic resin, constituting an insulating member. The plug contacts 370 are each made of a metal strip. The plug contacts 370 are arranged on both sides of the plug body 360 longitudinally so as to correspond to the receptacle contacts 330 of the receptacle connector 310 at the same pitch.

A fitting wall portion 362 is formed to surround a recess 363 which has a generally rectangular shape in plan view. The fitting wall portion 362 fits into the plug-in slot 321 when the plug connector 350 is fitted to the receptacle connector 310. The plug body 360 is an insulating member made of, for example, Nylon 9T™, modified nylon, or liquid crystal polymer. The plug body 360 is integrally molded (insert molded) with the plug contacts 370. A fitting protrusion 361 is formed in the center of the recess 363. The fitting protrusion 361 fits into the fitting recess 341 when the plug connector 350 is fitted to the receptacle connector 310.

The use of the above simple structure (i.e., the third embodiment) compared to the first and second embodiments makes it possible to achieve a connector of reduced manufacturing cost and reduced size (height), capable of absorbing fitting deviations and achieving a properly orientated fit.

The other operations, effects, and modifications are the same as those of the first and second embodiments.

According to the present invention, the pilot portions are formed on the plug body, and the guide recesses and the accommodation portions are formed in the receptacle body. This construction makes it possible to provide a connector having a reduced height which can absorb large fitting deviations occurring during a manual or automatic fitting process, and can be fitted in a properly orientated position.

Since the receptacle body has slopes at the four corners of the island portion, it becomes easier to guide the plug connector into the fitting position. The plug connector also makes contact with the slopes at the inner surfaces (the ridge lines between the inner surfaces and the bottom surfaces) of its wall portions, thereby facilitating the correction of rotational deviations. This makes the plug connector more likely to come into alignment with the receptacle connector, with an improvement to the efficiency of the fitting operation.

Moreover, since the plug body includes the pilot portions, and the receptacle body includes the guide recesses, the accommodation portions, and the slopes, it is possible to absorb fitting deviations with high precision effectively and achieve a properly orientated fit.

Furthermore, the at least two pilot portions formed on the plug body are guided by the at least two guide recesses which are formed in the receptacle body so as to correspond to the pilot portions, respectively. This construction brings the pilot slopes and the guide slopes into contact with each other even if the plug body and the receptacle body are deviated in position. It is therefore possible to prevent such only one of the pilot portions being inserted into a guide recess exclusively, and prevent the plug connector rotating about this pilot portion. Namely, an oblique fitting wherein only one of the pilot portions is in contact is less likely to occur. Accordingly, it is less likely that the plug connector and the receptacle connector would deviate in parallel from each other or rotate with respect to each other within the same plane. As a result, it is possible to obtain predetermined stable fitting behavior by which the two connectors are unlikely to be damaged.

Stable fit can also be obtained without many variations. It is also possible to obtain a definite click feeling, which can ensure the recognition of a proper fit.

This characteristic is useful for connector fitting under poor visibility. Hence, in a manual fitting process, the operator can recognize the completion of the fit. In an automatic fitting process, an incomplete fit can be detected.

The flat tops of the pilot portions can reduce the possibility of the receptacle connector being damaged through contact therewith, and reduce the possibility of the pilot portions entering into places other than the guide recesses. More specifically, in an automatic fitting process or in a manual fitting process, the plug connector is sometimes slid over the receptacle connector in order to find the fitting position due to poor visibility. Even in this operation, the pilot portions, having the flat tops, will not scratch the receptacle body with their tops or enter into places other than the regular fitting position. The tops of the pilot portions themselves can also be prevented from being worn out or damaged.

The flat top surfaces are given a minimum width greater than the width of the plug-in slot of the receptacle body and the arrangement pitch of the receptacle contacts. This prevents the pilot portions from entering between adjoining receptacle contacts or entering into the gaps of the receptacle contacts for the plug connector to be plugged into, and reduces the possibility of deforming the receptacle contacts.

Although the present invention has been described with reference to the foregoing embodiments, it is understood that the invention is not limited to the embodiments, and various improvements and modifications may be made for the purpose of improvement or within the scope of the concept of the invention.

What is claimed is:

1. A connector comprising:

a plug connector including a plug body made of an insulating member, and at least one plug contact held by said plug body; and a receptacle connector including a receptacle body made of an insulating member, said receptacle body having a plug-in slot for said plug connector to be plugged into and unplugged from, and at least one receptacle contact held by said receptacle body so as to make contact with said plug contact for electric connection when said plug connector is plugged into said plug-in slot, wherein said plug-in slot is formed between an island portion having a generally cuboid shape formed on the center of said receptacle body, and opposing wall portions of said receptacle body formed so as to oppose lateral surfaces of said island portion, and wherein four corners at the top of the island portion are formed as slopes which approach the wall portions and extend downward from the top of the island portion, and are connected to the lateral surfaces which extend vertically, wherein said plug body includes at least two pilot portions positioned at ends of the plug connector which protrude toward the receptacle connector along a plug/unplugging direction of said plug connector, each of said pilot portions having at least two pilot slopes which are formed so as to approach each other, and wherein said receptacle body includes at least two guide recesses for guiding said pilot portions of said plug body, respectively, when said plug connector is plugged into said receptacle connector, each of said guide recesses having at least two guide slopes which are formed so as to guide said pilot slopes, respectively, when the plug connector is plugged into the receptacle connector, each of the guide recesses having the at least guide slopes being faced with the slopes and the lateral surface of the island portion.

2. The connector according to claim 1, wherein said guide slopes include the slopes of the island portion.

3. The connector according to claim 1, wherein said wall portions of said island portion include wall portion pilot slopes which are formed so as to draw away from said opposing wall portions of said receptacle body and extend toward the top of said island portion.

4. The connector according to claim 1, wherein ridge lines across which the slopes and the lateral surfaces of said island portion connect to each other are straight.

5. The connector according to claim 1, wherein ridge lines across which the slopes and the lateral surfaces of said island portion connect to each other have an arc shape.

* * * * *